US006238264B1

(12) United States Patent
Kazami et al.

(10) Patent No.: US 6,238,264 B1
(45) Date of Patent: May 29, 2001

(54) WALKING APPARATUS

(75) Inventors: Keiichi Kazami; Shin-ichi Suda; Masayoshi Sato; Yuji Sawajiri, all of Tochigi (JP)

(73) Assignee: Kabushiki Kaisha Bandai, Tokyo (JP)

( * ) Notice: Subject to any disclaimer, the term of this patent is extended or adjusted under 35 U.S.C. 154(b) by 0 days.

(21) Appl. No.: 09/442,202

(22) Filed: Nov. 16, 1999

(30) Foreign Application Priority Data

Nov. 30, 1998 (JP) ..... 10-340083

(51) Int. Cl.[7] ..... A63H 3/20
(52) U.S. Cl. ..... 446/356; 446/368; 446/377
(58) Field of Search ..... 446/353, 356, 446/368, 377, 390

(56) References Cited

U.S. PATENT DOCUMENTS 3,331,463 * 7/1967 Kramer ..... 446/356 X
4,629,440 * 12/1986 McKittrick et al. ..... 446/356
4,666,419 * 5/1987 Droller et al. ..... 446/390 X
5,423,708 * 6/1995 Allen ..... 446/356

FOREIGN PATENT DOCUMENTS 62-26144 10/1981 (JP) .

* cited by examiner

*Primary Examiner*—John A. Ricci
(74) *Attorney, Agent, or Firm*—Baker & McKenzie

(57) ABSTRACT

A walking apparatus 1 that is capable of making movements close to a real insect has an apparatus body 2 provided with a power source 35. The apparatus body 2 is provided with at least two of rotating members 75, 61, 45 and 61 in its left and right sides. Through holes 53, 71 and 83 to which leg portions 105, 106 and 107 are rotatably and slidably mounted are formed in the rotating members 45, 61 and 75. The through holes 53, 71 and 83 are provided obliquely with respect to rotational axial lines S1 of the rotating members 45, 61 and 75. Guiding grooves 103 for guiding rear end parts 121, 122 and 123 of the leg portions 105, 106 and 107 extending from inner openings 55, 72 and 85 of the rotating members 45, 61 and 75 by not allowing the leg portions 105, 106 and 107 to rotate on their axes are formed in the apparatus body 2. The rotating members 45, 61 and 75 are rotated by the power source 35.

8 Claims, 9 Drawing Sheets

(a)

(b)

(a)

(b)

WALKING APPARATUS

BACKGROUND OF THE INVENTION

1. Field of the Invention

This invention relates to a walking apparatus that is used for a toy such as an insect toy.

2. Description of the Related Art

There is known a conventional insect toy that is swingably provided with a front leg stick, a middle leg stick and a rear leg stick under its body, which are swung to slidingly advance the body on a walking surface as described in Japanese Examined Utility Model Publication No. Sho 62-26144.

The conventional insect toy has a problem of lacking realism because it is swingably provided with a front leg stick, a middle leg stick and a rear leg stick under its body, whereas an actual insect has legs extending from its body. In addition, there is a problem that a conventional insect toy can not overcome even a small gap and stops because it slidingly proceeds. Hence, its movement is entirely different from that of an actual insect that can overcome and proceed through such a gap.

SUMMARY OF THE INVENTION

The present invention has been made in view of the above-described drawbacks, and therefore it is an object of the present invention to provide a walking apparatus having a shape similar to that of an actual insect and capable of making movements similar to those of an actual insect.

In order to attain the above-described object, a walking apparatus according to a first aspect of the present invention is comprised of: an apparatus body provided with a power source; at least two rotating members provided on each of the left and the right sides of the apparatus body; a through hole formed in the rotating member; the through hole being provided obliquely with respect to a rotational axial line of the rotating member, and being formed to connect an inner opening and an outer opening, the inner opening being formed toward the center of the inner side surface of the rotating member and the outer opening being formed toward the circumference of the outer side surface of the rotating member; a leg portion rotatably and slidably mounted to the through hole of the rotating member; a guiding groove for slidably guiding a rear end part of the leg portion protruding from the inner opening of the rotating member formed in the apparatus body thereby preventing the leg portion from turning on its axis; and the rotating member that rotates by the power source.

In order to attain the above-described object, according to a second aspect of the present invention, in a walking apparatus of the first aspect of the present invention, the guiding groove is formed substantially parallel with the rotational axial line of the rotating member, and the leg portion includes a rear part protruding from the inner opening of the rotating member to be bent and a rear end part guided slidably into the guiding groove.

In order to attain the above-described object, according to a third aspect of the present invention, in a walking apparatus of the first aspect of the present invention, the apparatus body includes a bottom wall and side walls provided in the left and the right of the bottom wall, each of the left and the right side walls includes at least two rotating members, and the guiding groove is formed in the bottom wall.

A walking apparatus according to a fourth aspect of the present invention has two power sources described above, one of which rotates the rotating member in one of the side walls and the other power source rotates the rotating member in the other side wall. A walking apparatus according to a fifth aspect of the present invention has a gear wheel as a rotating member.

DETAILED DESCRIPTION OF THE INVENTION

Figure 1:
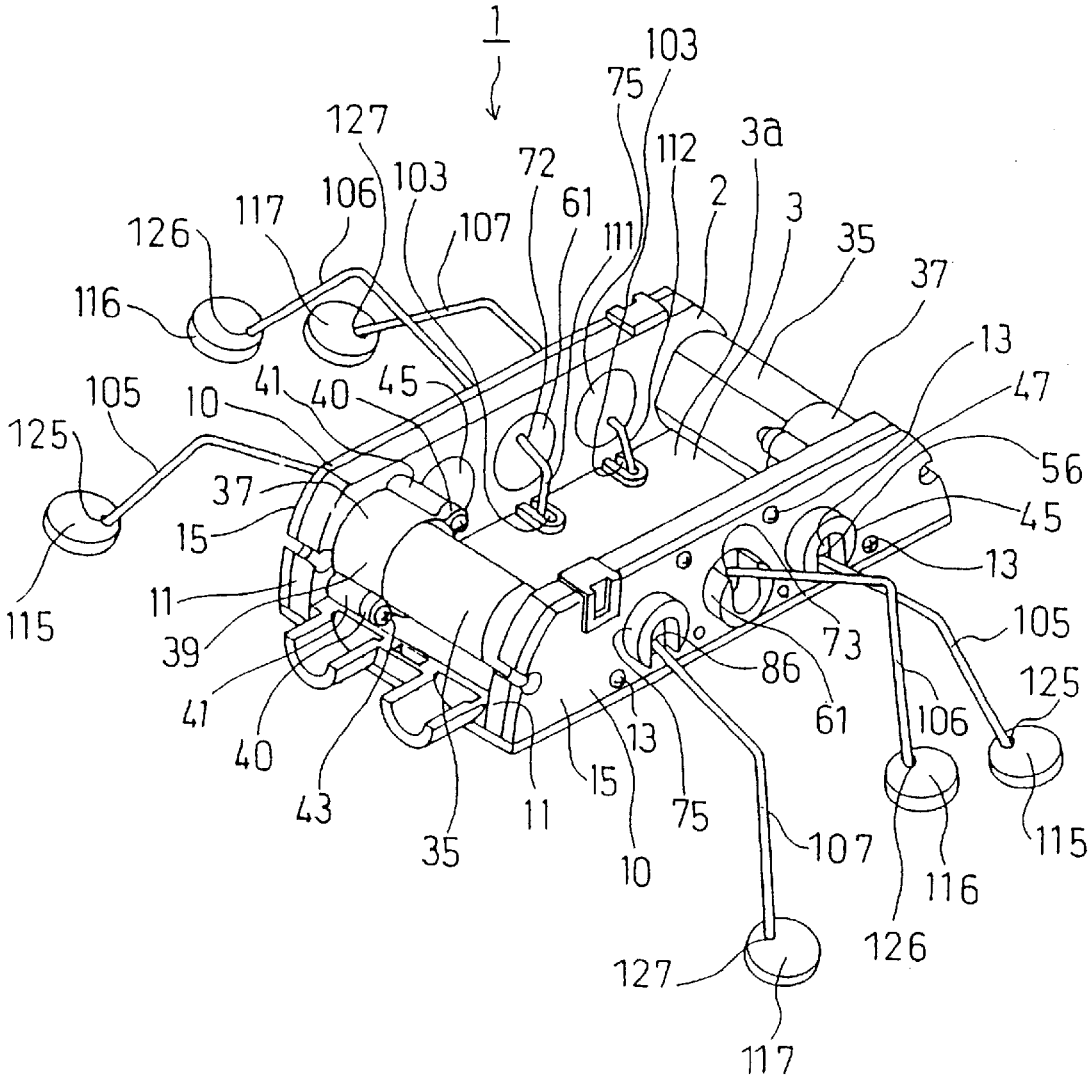
FIG. 1 is an overall perspective view of a walking apparatus according to an embodiment of the present invention.
Figure 2:
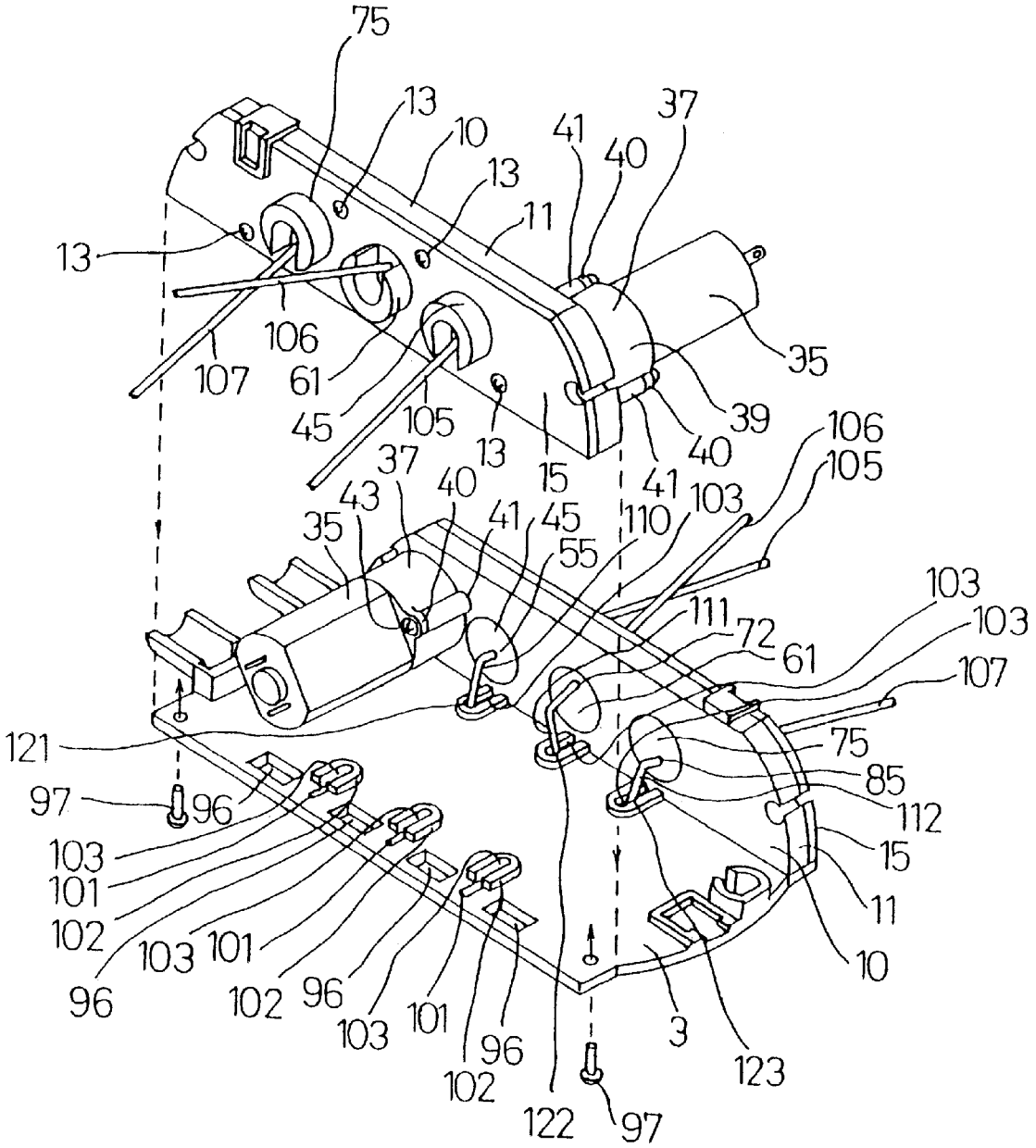
FIG. 2 is an exploded perspective view of FIG. 1 partially omitted.
Figure 3:
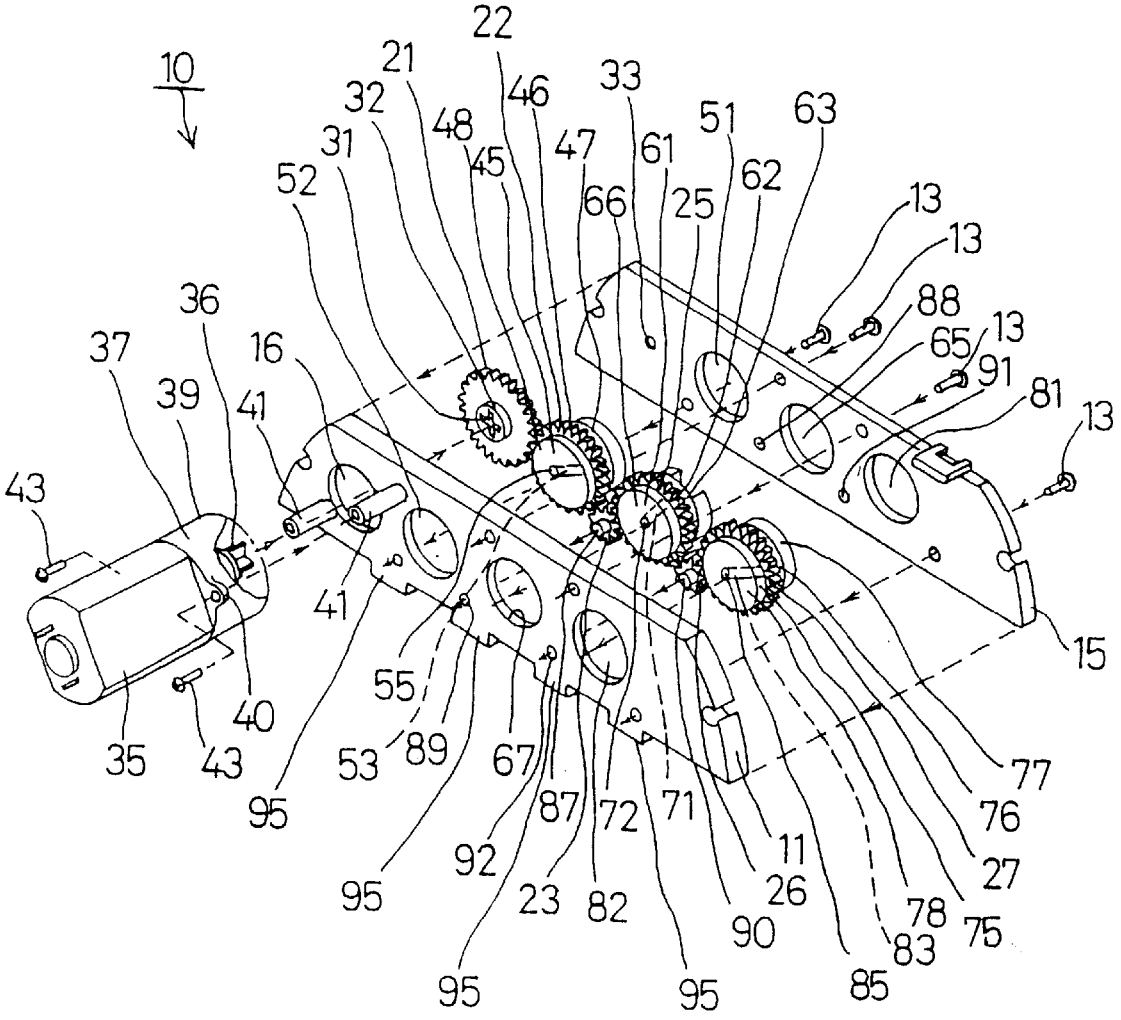
FIG. 3 is an exploded perspective view of the main part of FIG. 1.
Figure 4:
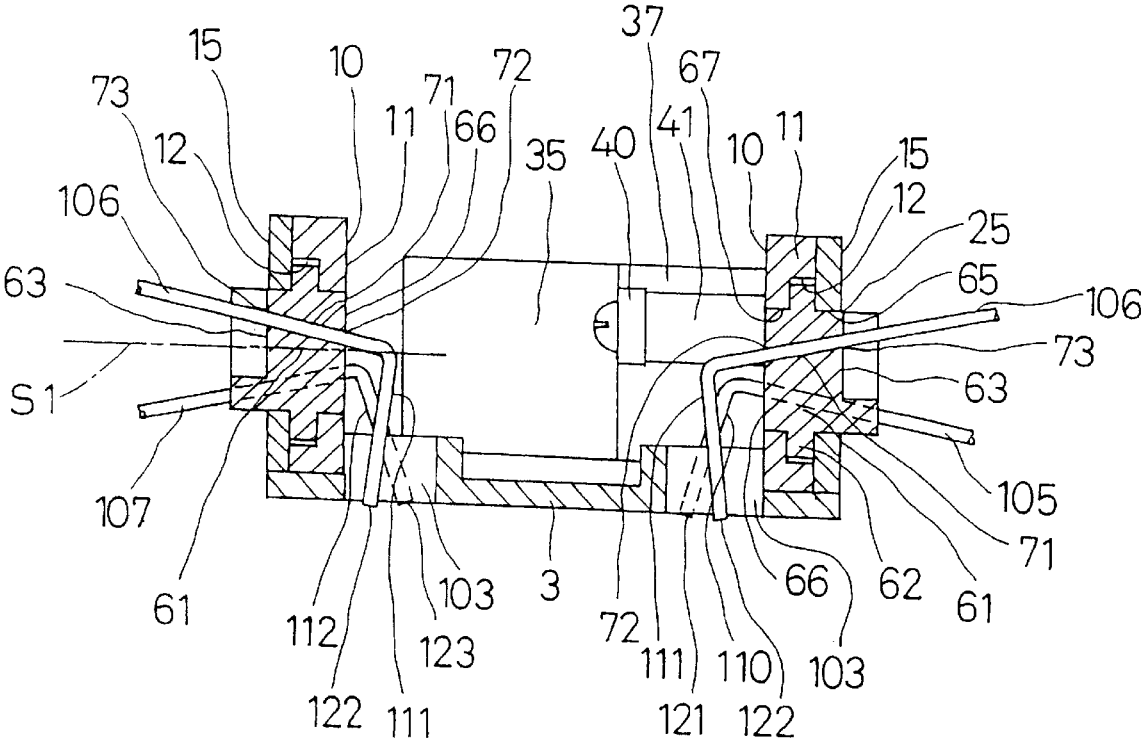
FIG. 4 is a front sectional view of FIG. 1.

A walking apparatus embodying the present invention is now described with reference to FIG. 1 through FIG. 4. FIG. 1 is an overall perspective view of a walking apparatus according to embodiment of the present invention. FIG. 2 is an exploded perspective view of FIG. 1 partially omitted. FIG. 3 is an exploded perspective view of the main part of FIG. 1. FIG. 4 is a front sectional view of FIG. 1.

A walking apparatus 1 according to a first aspect of the present invention has an apparatus body 2 provided with a power source 35. At least two of rotating members 75, 61, 45 and 61 are provided on each of the left and the right sides of the apparatus body 2. Through holes 53, 71 and 83 are formed in the rotating members 45, 61 and 75. The through holes 53, 71 and 83 are provided obliquely with respect to rotational axial lines S1 of the rotating members 45, 61 and 75 and are formed to connect inner openings 55, 72 and 85 formed toward the center of inner surfaces 48, 66 and 78 of the rotating members 45, 61 and 75 and outer openings 56, 73 and 86 formed toward the circumference of outer surfaces 47, 63 and 77 of the rotating members 45, 61 and 75.

Leg portions 105, 106 and 107 are rotatably and slidably mounted to the through holes 53, 71 and 83 of the rotating member 45, 61 and 75. Guiding grooves 103 are formed in the apparatus body 2 for slidably guiding rear end parts 121, 122 and 123 of the leg portions 105, 106 and 107 protruding from the inner opening 55, 72 and 85 of the rotating members 45, 61 and 75 such that the leg portions 105, 106 and 107 do not rotate on its axis. The rotating members 45, 61 and 75 are rotated by the power source 35.

The walking apparatus 1 according to the first aspect of the present invention has the above-described structure and can change the direction of rotation of the through holes 53, 71 and 83 of the rotating members 45, 61 and 75 with ease. In the embodiment, the direction of the through hole 83 of the rotating member 75 in the front portion on the left side and the direction of the through hole 71 of the rotating member 61 in the rear part on the right side are made in the same manner, the direction of the through hole 53 of the rotating member 45 in the front portion on the right side and the direction of the through holes 71 of the rotating member 61 in the rear part on the left side are made the same, and the direction of the through hole 83 of the rotating member 75 in the front portion on the left side and the direction of the through hole 53 of the rotating member 45 in the front portion on the right side, facing each other, are made opposite and the direction of the through hole 71 of the rotating member 61 in the rear part of the left side and the direction of the through hole 71 of the rotating member 61 in the rear part of the right side are made opposite.

In the walking apparatus 1, when the power source 35 is activated, at least two of the rotating members 75, 61, 45 and 61 provided on the left and the right sides of the apparatus body 2 rotate. The leg portions 107, 106, 105 and 106, supported with the through holes 83, 71, 53 and 71, rotate about the rotational axial lines S1 of the rotating members 75, 61, 45 and 61 by the rotation of the rotating members 75, 61, 45 and 61. Front end parts 127, 126, 125 and 126 of the leg portions 107, 106, 105 and 106 rotate widely up and down because the through holes 83, 71, 53 and 71 are oblique with respect to the rotational axial lines S1 of the rotating members 75, 61, 45 and 61.

When the front end parts 127 and 126 of the leg portion 107 in the front portion on the left side and the leg portion 106 in the rear part on the right side touch a walking surface, the front end parts 125 and 126 of the leg portion 105 in the front portion on the right side and the leg portion 106 in the rear part on the left side move away from the walking surface, and when the front end parts 125 and 126 of the leg portion 105 in the front portion on the right side and the leg portion 106 in the rear part on the left side touch the walking surface, the front end parts 127 and 126 of the leg portion 107 in the front portion on the left side and the leg portion 106 in the rear part on the right side move away from the walking surface, thereby at least two legs touch the walking surface in turn and the apparatus walks. The front end parts 125, 126 and 127 of the leg portions 105, 106 and 107 always face downward because the leg portions 105, 106 and 107 are made not to rotate on its axis by the guiding grooves 103. Further, although two legs are herein explained as provided on each of the left and the right sides, it is preferable to provide three legs on each of the left and the right sides.

A walking apparatus 1 according to a second aspect of the present invention is formed such that the guiding grooves 103 are substantially parallel with the rotational axial lines S1 of the rotating members 45, 61 and 75. The rear parts 110, 111 and 112 of the leg portions 105, 106 and 107 protrude from the inner openings 55, 72 and 85 of the rotating members 45, 61 and 75 and are bent, and the rear end parts 121, 122 and 123 are slidably guided into the guiding grooves 103.

When the guiding grooves 103 are formed such that they are substantially parallel with the rotational axial lines S1 of the rotating members 45, 61 and 75, although properly changeable, the rear end parts 121, 122 and 123 of the leg portions 105, 106 and 107 slide into the guiding grooves 103 smoothly because the rotational centers of the leg portions 105, 106 and 107 are always above the guiding grooves 103.

A walking apparatus 1 according to a third aspect of the present invention has the apparatus body 2 comprising a bottom wall 3 and side walls 10 provided on the left and the right sides of the bottom wall 3. At least two of the rotating members 75, 61, 45 and 61 are provided in each of the left and the right side walls 10. The guiding grooves 103 are formed in the bottom wall 3.

The walking apparatus 1 according to the third aspect of the present invention has a space 3*a* between the side walls 10 because the leg portions 107, 106, 105 and 106 are attached to the rotating members 75, 61, 45 and 61 of the left and the right side walls 10, and the space 3a can be utilized to incorporate electric parts such as batteries and circuit substrates.

A walking apparatus 1 according to a fourth aspect of the present invention has two power sources 35, and the one power source 35 rotates the rotating members 75 and 61 of the one side wall 10 and the other power source 35 rotates the rotating members 45 and 61 of the other side wall 10.

When both the power sources 35 are activated simultaneously to rotate regularly the rotating members 75 and 61 of the one side wall 10 and the rotating members 45 and 61 of the other side wall 10 to the same direction, a walking apparatus 1 according to the fourth aspect of the present invention walks forward, and when to rotate them reversedly to the same direction, the apparatus walks backward. Also, when both the power sources 35 are activated simultaneously to rotate the rotating members 75 and 61 of the one side wall 10 and the rotating members 45 and 61 of the other side wall 10 to the different directions, the apparatus turns over quickly in its position. Moreover, when the one power source 35 is activated to rotate only the rotating members 75 and 61 of the one side wall 10, the apparatus rotates about the front end parts 125 and 126 of the leg portions 105 and 106 of the other side wall 10.

A walking apparatus 1 according to a fifth aspect of the present invention has gear wheels 22, 25 and 27 as the rotating members 45, 61 and 75. The rotating members 45, 61 and 75 may be anything that can be rotated by the power source 35, and therefore they may be friction wheels or chain sprockets. However, power is efficiently transmitted from the power source to the rotating members if they are gear wheels 22, 25 and 27.

Figure 5:
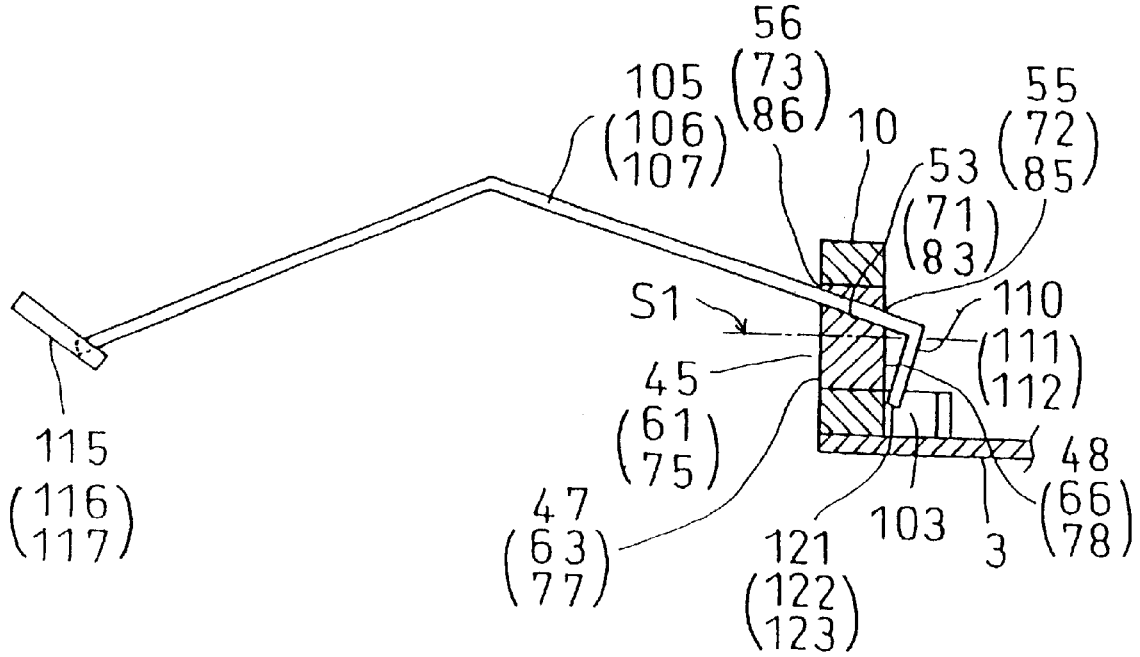
FIGS. 5(*a*) and (*b*) are principle explanatory views of a walking apparatus.
Figure 5:
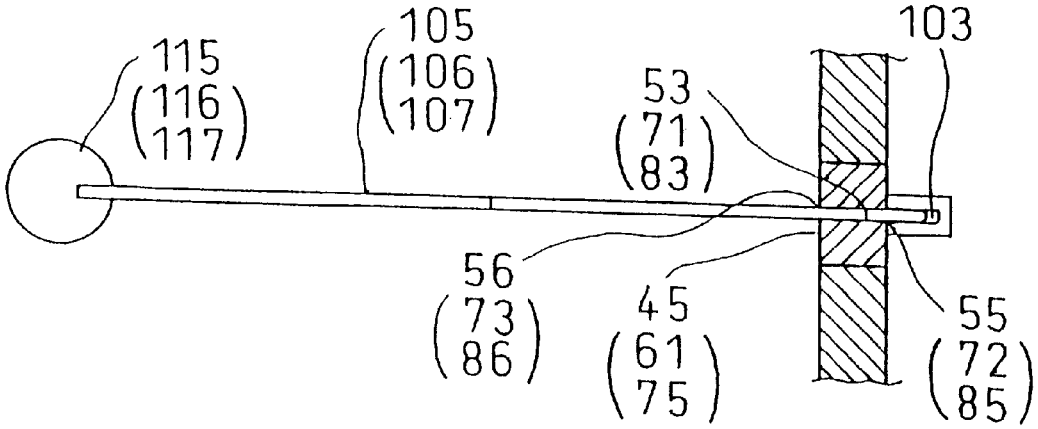

An embodiment of a walking apparatus according to the present invention is now further described in detail with reference to FIG. 1 through FIG. 9. FIG. 1 is an overall perspective view of a walking apparatus according to an embodiment of the present invention. FIG. 2 is an exploded perspective view of FIG. 1 partially omitted. FIG. 3 is an exploded perspective view of the main part of FIG. 1. FIG. 4 is a front sectional view of FIG. 1. FIGS. 5(*a*) through 8(*b*) are principle explanatory views of a walking apparatus. FIG. 9 is an overall perspective view of a toy to which a walking apparatus is applied.

A walking apparatus 1 has an apparatus body 2. The apparatus body 2 comprises a bottom wall 3 and side walls 10 provided on both of the left and the right sides of the bottom wall 3. A side wall 10 consists of a frame member 11 in which a housing recess 12 is formed and a covering member 15 attached to the frame member 11 by a screw 13, etc. such that the covering member 15 shuts up the housing recess 12.

A driving gear wheel 21, a first rotating gear wheel 22 for gearing with the driving gear wheel 21, a first supporting gear wheel 23 for gearing with the first rotating gear wheel 22, a second rotating gear wheel 25 for gearing with the first supporting gear wheel 23, a second supporting gear wheel 26 for gearing with the second rotating gear wheel 25 and a third rotating gear wheel 27 for gearing with the second supporting gear wheel 26 are rotatably provided in the housing recess 12.

The driving gear wheel 21 is provided with a rotational shaft (not shown) on one of its sides and a protrusion 32 in which a fitting groove 31 in a substantially cross shape is formed on the other side. The rotational shaft (not shown) of the driving gear wheel 21 is rotatably supported by a bearing hole 33 of the covering member 15. A fitting protrusion 36 in a substantially cross shape attached to an outputting shaft of a driving motor 35 is detachably fitted with the fitting groove 31 of the driving gear wheel 21.

The driving motor 35 is provided with a reduction gear 37 in its front part and a fitting protrusion 36 in an outputting shaft of the reduction gear 37. A case 39 of the reduction gear 37 is protrudingly provided with attaching members 40 on both its sides. The driving motor 35 is fixed to the frame member 11 with the attaching members 40 being attached to attaching shafts 41 provided in the frame member 11 by screws 43. The fitting protrusion 36 of the driving motor 35 passes through a hole 16 formed in the frame member 11 and fits with the fitting groove 31 of the driving gear wheel 21 as described above.

The first rotating gear wheel 22 comprises a rotating member 45 in conical shape and teeth 46 formed on the circumference of the rotating member 45. The first rotating gear wheel 22 is rotatably mounted in the side wall 10 with an outer side surface 47 side of the rotating member 45 being rotatably supported by a first outer bearing hole 51 formed in the covering member 15 and an inner side surface 48 side of the rotating member 45 being rotatably supported by a first inner bearing hole 52 formed in the frame member 11.

A through hole 53 is formed in the rotating member 45. The through hole 53 is formed obliquely with respect to rotational axial line S1 of the rotating member 45 and is formed to connect an inner opening 55 formed toward the center of the inner surface 48 of the rotating member 45 and an outer opening 56 formed toward the circumference of the outer surface 47 of the rotating member 45.

The second rotating gear wheel 25 also comprises a rotating member 61 in conical shape and teeth 62 formed on the circumference of the rotating member 61. The second rotating gear wheel 25 is rotatably mounted in the side wall 10 with an outer side surface 63 side of the rotating member 61 being rotatably supported by a second outer bearing hole 65 formed in the covering member 15 and an inner side surface 66 side of the rotating member 61 being rotatably supported by a second inner bearing hole 67 formed in the frame member 11.

A through hole 71 is formed in the rotating member 61. The through hole 71 is formed obliquely with respect to a rotational axial line S1 of the rotating member 61 and is formed to connect an inner opening 72 formed toward the center of the inner surface 66 of the rotating member 61 and an outer opening 73 formed toward the circumference of the outer surface 63 of the rotating member 61.

The third rotating gear wheel 27 comprises a rotating member 75 in conical shape and teeth 76 formed on the circumference surface of the rotating member 75. The third rotating gear wheel 27 is rotatably mounted in the side wall 10 with an outer side surface 77 side of the rotating member 75 being rotatably supported by a third outer bearing hole 81 formed in the covering member 15 and an inner side surface 78 side of the rotating member 75 being rotatably supported by a third inner bearing hole 82 formed in the frame member 11.

A through hole 83 is formed in the rotating member 75. The through hole 83 is formed obliquely with respect to a rotational axial line S1 of the rotating member 75 and is formed to connect an inner opening 85 formed toward the center of the inner surface 78 of the rotating member 75 and an outer opening 86 formed toward the circumference of the outer surface 77 of the rotating member 75.

The first supporting gear wheel 23 is attached to a supporting shaft 87 and is rotatably mounted in the side wall 10 with the supporting shaft 87 being rotatably supported by a first bearing hole 88 formed in the covering member 15 and a second bearing hole 89 formed in the frame member 11. The second supporting gear wheel 26 is also attached to a supporting shaft 90 and is rotatably mounted in the side wall 10 with the supporting shaft 90 being rotatably supported by a third bearing hole 91 formed in the covering member 15 and a fourth bearing hole 92 formed in the frame member 11. Engaging protrusions 95 in rectangular shape are mounted with a predetermined interval at the lower end of the frame member 11.

Engaging holes 96 in rectangular shape for engaging the engaging protrusions 95 of the side wall 10 are formed in the left and the right sides of the bottom wall 3. The side wall 10 is positioned by engaging the engaging protrusions 95 in the engaging holes 96 of the bottom wall 3 and is fixed to the bottom wall 3 by a screw 97. Further, the side walls 10 to be fixed to both sides of the bottom wall 3 are mounted such that a driving motor 35 is inside the walls and driving motors 35 are placed in the front and the rear of the bottom wall 3.

Long holes 101 are formed on both sides of the bottom wall 3 and substantially the center between the engaging holes 96, and guiding protrusions 102 in substantially the shape of a letter U are formed in the circumference of the long holes 101 toward the center of the bottom wall 3. Guiding grooves 103 are formed by the guiding protrusions 102 and the long holes 101. The guiding grooves 103 are substantially perpendicular with the rotating members 45, 61 and 75 and are formed substantially parallel with each other right below the rotational axial lines S1 of the rotating members 45, 61 and 75.

Leg portions 105, 106 and 107 formed of wires are slidably and rotatably mounted in the through holes 53, 71 and 83 of the rotating members 45, 61 and 75. Rear parts 110, 111 and 112 of the leg portions 105, 106 and 107 protrude from the inner openings 55, 72 and 85 of the rotating members 45, 61 and 75 and are bent in substantially a right angle, and the rear end parts 121, 122 and 123 are slidably guided to the guiding grooves 103. The leg portions 105, 106 and 107 protruding from the outer openings 56, 73 and 86 of the rotating members 45, 61 and 75 are bent substantially at their centers, and foot plates 115, 116 and 117 in circular shape are attached to the front end parts 125, 126 and 127.

The walking apparatus 1 has the above-mentioned structure, and the direction of the through hole 53 of the first rotating gear wheel 22 and the direction of the through holes 83 of the third rotating gear wheel 27 are the same and the direction of the through hole 71 of the second rotating gear wheel 25 and the direction of the through hole 53 of the first rotating gear wheel 22 are made the opposite, and mounted in the side walls 10. Further, the direction of the through hole 53 of the first rotating gear wheel 22, the direction of the through hole 71 of the second rotating gear wheel 25 and the direction of the through hole 83 of the third rotating gear wheel 27 can be easily changed by changing the position where the teeth 46, 62 and 76 are geared.

The direction of a through hole for gear wheels facing each other in the side walls 10 mounted on the left and the right sides of the walking apparatus 1 can be easily adjusted by driving one of the driving motors 35. In this embodiment, The directions of through holes for gear wheels facing each other in the side walls 10 mounted on the left and the right sides of the walking apparatus 1 are made opposite by driving one of the driving motors 35. That is to say, the direction of the through hole 53 of the first rotating gear wheel 22 on the right side and the direction of the through hole 83 of the third rotating gear wheel 27 on the left side are made opposite, the direction of the through hole 71 of the second rotating gear wheel 25 on the right side and the direction of the through hole 71 of the second rotating gear wheel 25 on the left side are made opposite and the direction of the through hole 83 of the third rotating gear wheel 27 on the right side and the direction of the through hole 53 of the first rotating gear wheel 22 on the left side are made opposite.

The driving motor 35 in the front and the driving motor 35 in the rear are driven simultaneously to the different directions. When the driving motor 35 in the front is driven regularly, the fitting protrusion 36 rotates regularly via the reduction gear 37 and the first rotating gear wheel 22 rotates reversedly via the fitting groove 31 and the driving gear wheel 21. When the first rotating gear wheel 22 rotates reversedly, the second rotating gear wheel 25 rotates reversedly via the first supporting gear wheel 23. When the second rotating gear wheel 25 rotates reversedly, the third rotating gear wheel 27 rotates reversedly via the second supporting gear wheel 26.

Similarly, when the driving motor 35 in the rear is driven reversedly, the fitting protrusion 36 rotates reversedly via the reduction gear 37 and the first rotating gear wheel 22 rotates regularly via the fitting groove 31 and the driving gear wheel 21. When the first rotating gear wheel 22 rotates regularly, the second rotating gear wheel 25 rotates regularly via the first supporting gear wheel 23. When the second rotating gear wheel 25 rotates regularly, the third rotating gear wheel 27 rotates regularly via the second supporting gear wheel 26.

Since the side walls 10 are mounted opposite each other, the first rotating gear wheel 22 on the right side and the third rotating gear wheel 27 on the left side, the second rotating gear wheel 25 on the right side and the second rotating gear wheel 25 on the left side, and the third rotating gear wheel 27 on the right side and the first rotating gear wheel 22 on the left side, facing each other respectively, rotate in the same direction.

When the first rotating gear wheel 22 rotates, the rotating member 45 and the through hole 53 rotate about the rotational axial line S1 of the rotating member 45. Therefore, the leg portion 105 mounted in the through hole 53 also rotates about the rotational axial line S1 of the rotating member 45. Since the leg portion 105 has the rear end part 121 of the bent rear part 110 that is slidably guided to the guiding groove 103, it does not rotate on its axis but rotates with the foot plate 115 always in the lower side.

Movement of the leg portion 105 is now described with reference to the principle explanatory views of FIGS. 5(*a*) through 8(*b*). FIG. 5(*a*) is a side sectional view of the leg portion 105 when it is in the top position, and FIG. 5(*b*) is a plan sectional view showing the leg portion 105 in FIG. 5(*a*) viewed from the above. Here, the foot plate 115 is in a state where it is most distant from the walking surface and the rear end part 121 of the rear part 110 is in the left side of the guiding groove 103.

Figure 6:
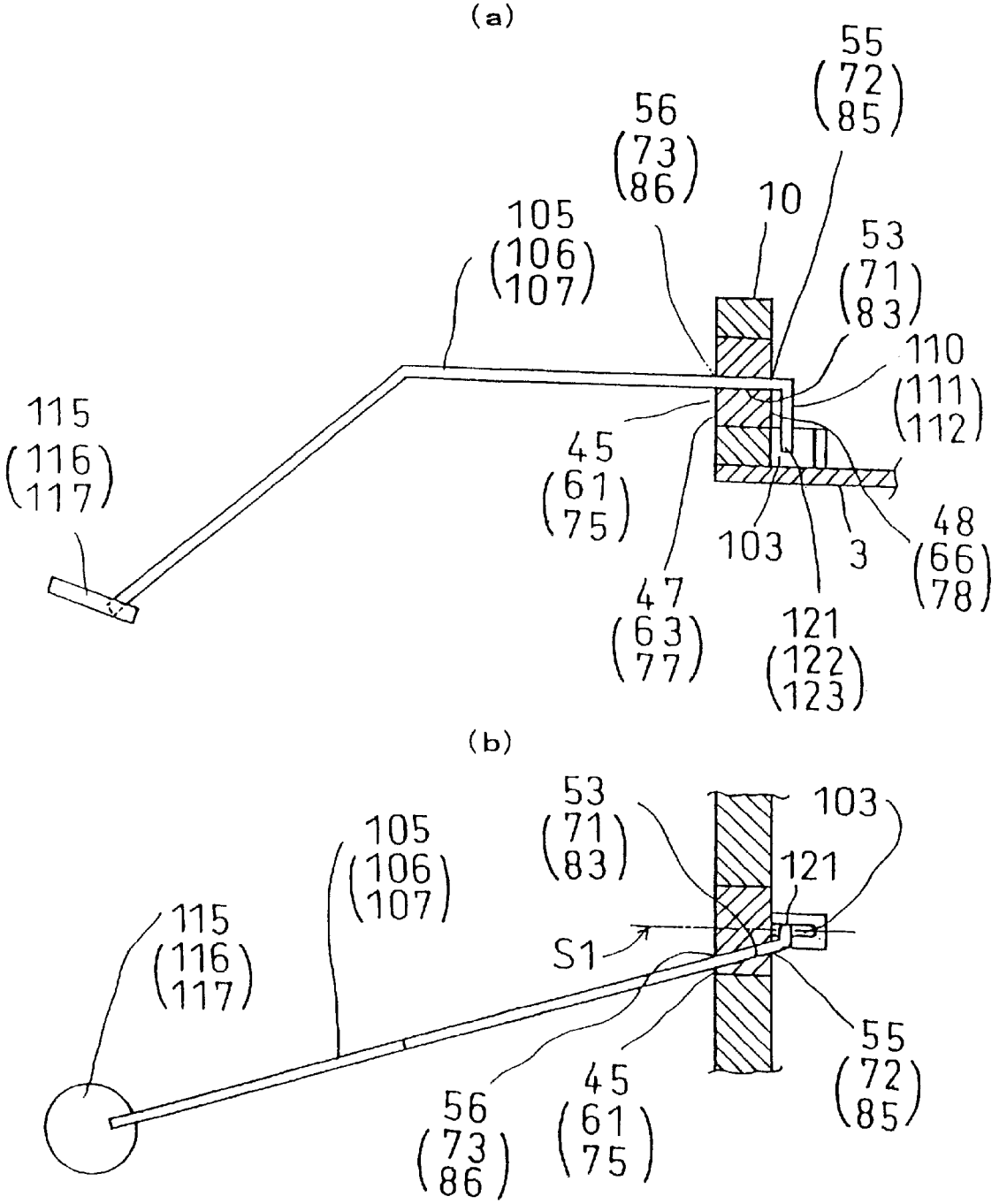
FIGS. 6(*a*) and (*b*) are principle explanatory views of a walking apparatus.

FIG. 6(*a*) is a side sectional view of the leg portion 105 turned substantially 90 degrees to one direction from the position in FIG. 5(*a*), and FIG. 6(*b*) is a plan sectional view showing the leg portion 105 in FIG. 6(*a*) viewed from the above. Here, the foot plate 115 is in a state where it is moved forward and the rear end part 121 of the rear part 110 is in substantially the middle of the guiding groove 103.

Figure 7:
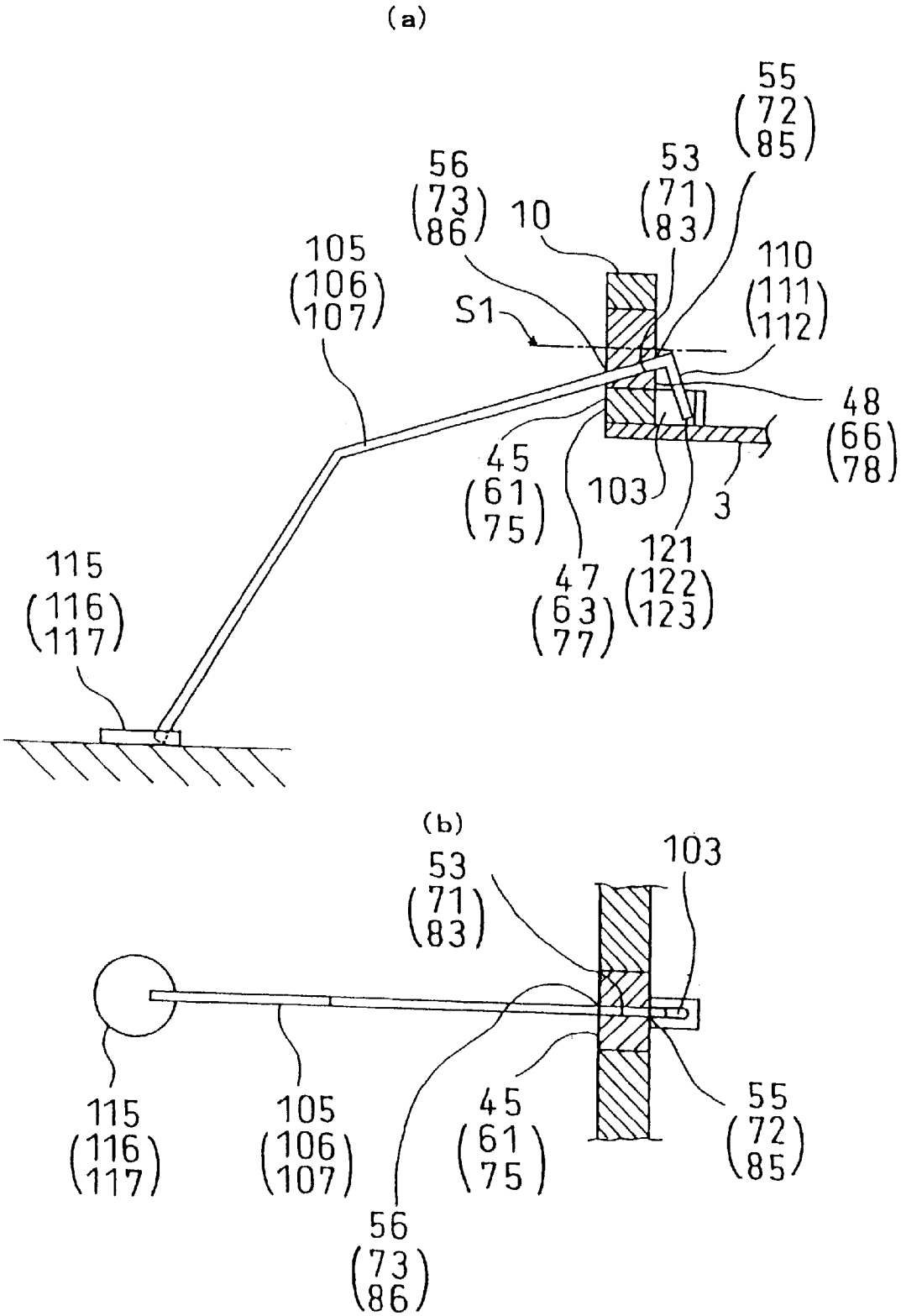
FIGS. 7(*a*) and (*b*) are principle explanatory views of a walking apparatus.

FIG. 7(*a*) is a side sectional view of the leg portion 105 turned substantially 90 degrees to one direction from the position in FIG. 6(*a*), and FIG. 7(*b*) is a plan sectional view showing the leg portion 105 in FIG. 7(*a*) viewed from the above. Here, the foot plate 115 is in the state where it touches the walking surface and the rear end part 121 of the rear part 110 is in the right of the guiding groove 103.

Figure 8:
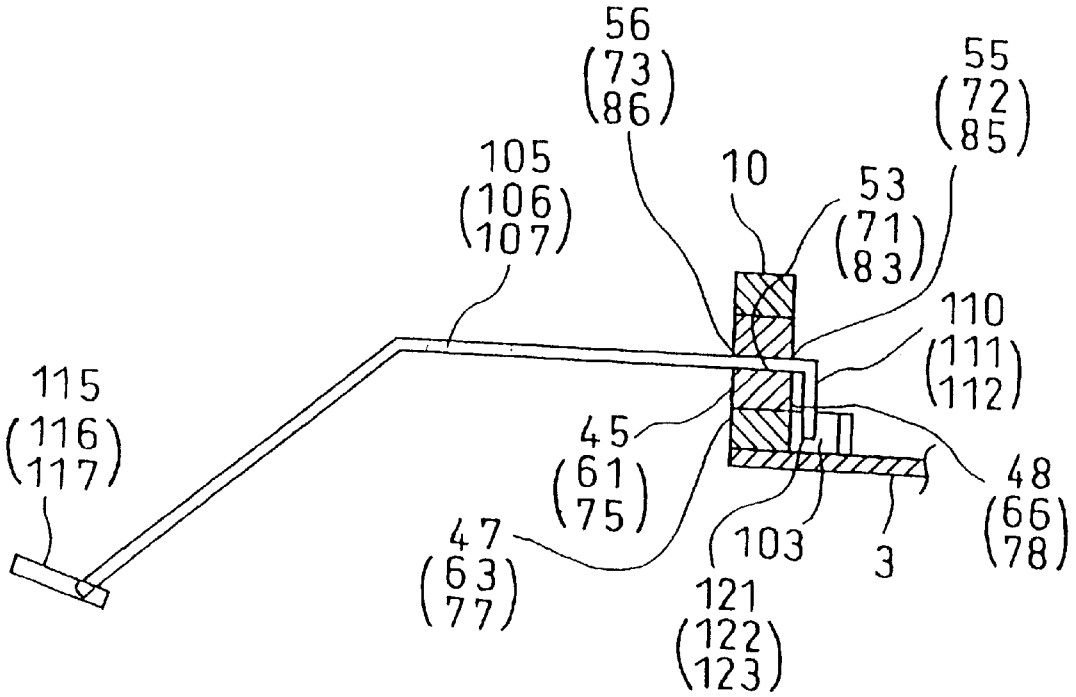
FIGS. 8(*a*) and (*b*) are principle explanatory views of a walking apparatus.
Figure 8:
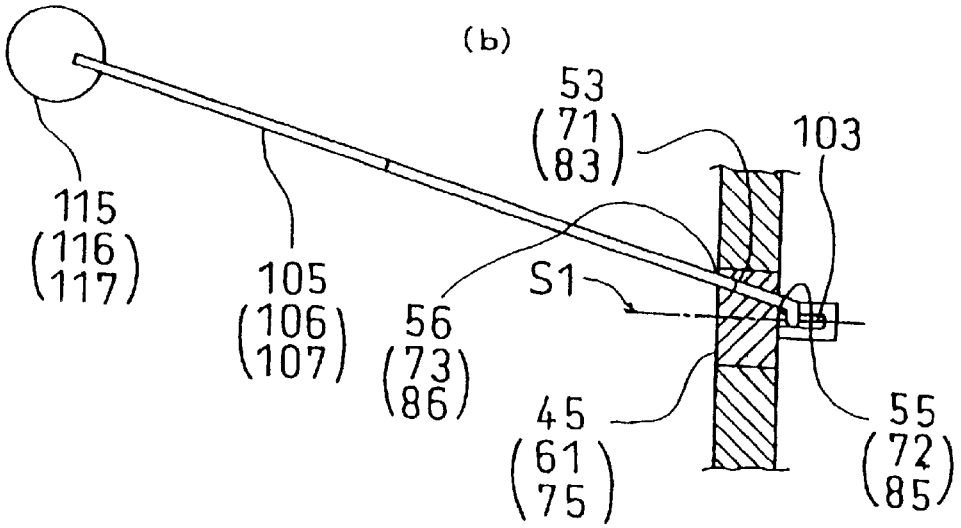
Figure 9:
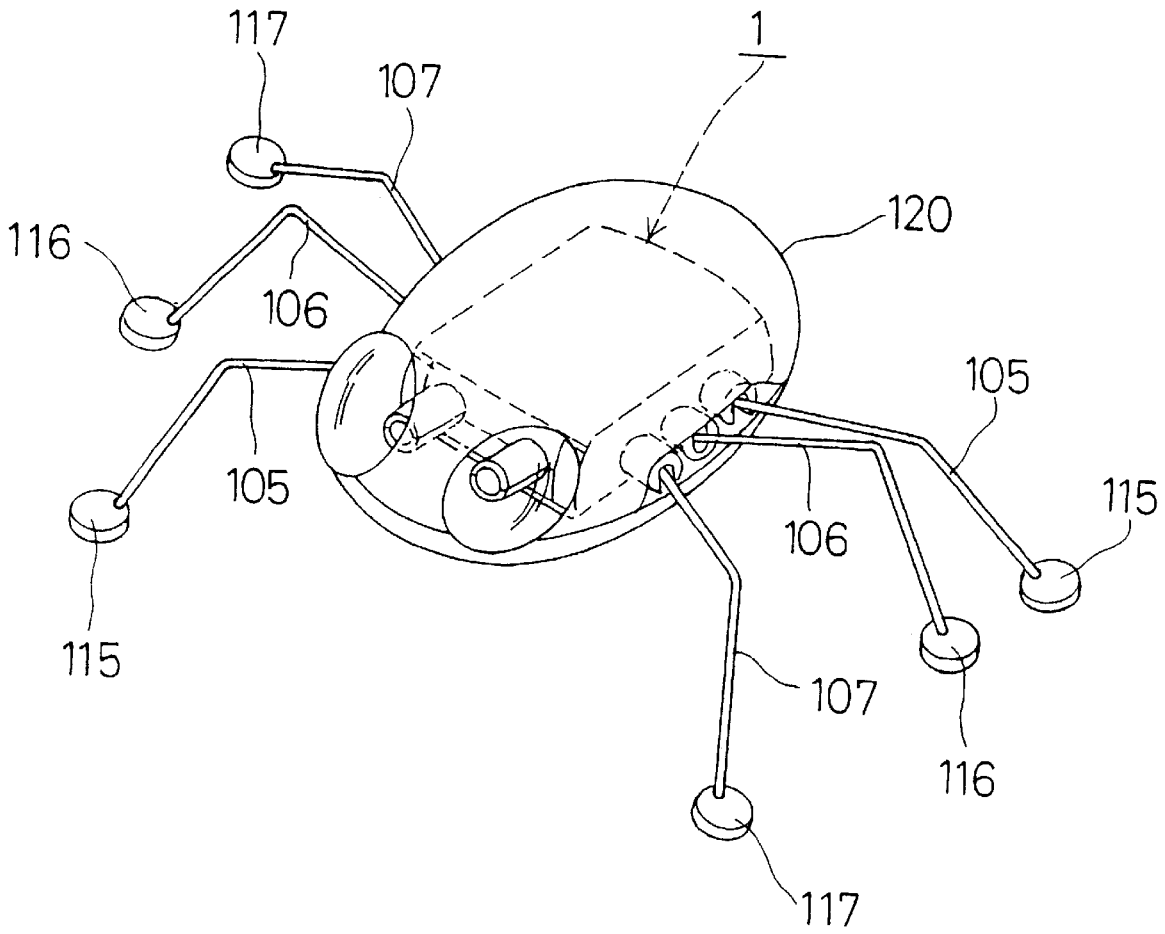
FIG. 9 is an overall perspective view of a toy to which a walking apparatus is applied.

FIG. 8(*a*) is a side sectional view of the leg portion 105 turned substantially 90 degrees to one direction from the position in FIG. 7(*a*), and FIG. 8(*b*) is a plan sectional view showing the leg portion 105 in FIG. 8(*a*) viewed from the above. Here, the foot plate 115 is in the state where it is moved backward and the rear end part 121 of the rear part 110 is in substantially the middle of the guiding groove 103.

The rotating members 61 and 75 rotate because the second rotating gear wheel 25 and the third rotating gear wheel 27 also rotate, and the through holes 71 and 83 rotate about the rotational axial lines S1 of the rotating members 61 and 75. Therefore, the leg portions 106 and 107 supported in the through holes 71 and 83 also rotate about the rotational axial lines S1 of the rotating members 71 and 83 as the leg portion 105 rotates, as described above.

As mentioned above, the direction of rotation of the through hole 53 of the first rotating gear wheel 22 and the direction of the through hole 83 of the third rotating gear wheel 27 are the same. The direction of the through hole 71 of the second rotating gear wheel 25 and the direction of the through hole 53 of the first rotating gear wheel 22 are the opposite. The direction of the through hole 53 of the first rotating gear wheel 22 on the right side and the direction of the through hole 83 of the third rotating gear wheel 27 on the left side are the opposite. The direction of the through hole 71 of the second rotating gear wheel 25 on the right side and the direction of the through hole 71 of the second rotating gear wheel 25 on the left side are the opposite. The direction of the through hole 83 of the third rotating gear wheel 27 on the right side and the direction of the through hole 53 of the first rotating gear wheel 22 on the left side are the opposite.

Therefore, the leg portion 105 to be the right front leg, the leg portion 107 to be the right rear leg and the leg portion 106 to be the left middle leg touch the walking surface simultaneously, when the leg portion 107 to be the left front leg, the leg portion 105 to be the left rear leg and the leg portion 106 to be the right middle leg are away from the walking surface. When the leg portion 107 to be the left front leg, the leg portion 105 to be the left rear leg and the leg portion 106 to be the right middle leg touch the walking surface, the leg portion 105 to be the right front leg, the leg portion 107 to be the right rear leg and the leg portion 106 to be the left middle leg are removed from the walking surface.

When the driving motor 35 in the front is driven regularly and the driving motor 35 in the rear is driven reversedly, the walking apparatus 1 can be moved forward with the three legs being rotated in the same direction one after another as described above, and when the driving motor 35 in the front is driven reversedly and the driving motor 35 in the rear is driven regularly, the walking apparatus 1 can be moved backward with the three legs being rotated reversedly in the same direction one after another.

When the driving motor 35 in the front is driven regularly (reversedly) and the driving motor 35 in the rear is driven regularly (reversedly) as well, the direction of rotation of the leg portions 105, 106 and 107 on the right side and the direction of rotation of the leg portions 107, 106 and 105 on the left side are different, and the walking apparatus 1 can be turned over quickly in its present position. Further, the two driving motors 35 do not need to be driven simultaneously, and when one of the driving motors 35 is driven, the walking apparatus 1 can change the direction freely because only the leg portions 105, 106 and 107 on one side rotate.

As described above, since the direction of rotation of the through hole 53 of the first rotating gear wheel 22, the direction of the through hole 71 of the second rotating gear wheel 25 and the direction of the through hole 83 of the third rotating gear wheel 27 can be easily changed by changing the position where the teeth 46, 62 and 76 gear each other, the walking form of the walking apparatus 1 is not limited to the above-described embodiment but can be changed freely.

The walking apparatus 1 can move rhythmically with up and down movements and can easily overcome uneven surfaces in its way because it walks with the foot plates 115, 116 and 117 of the leg portions 105, 106 and 107 taking such motions as revolving in the up and down directions.

The walking apparatus 1 has the space 3*a* formed in the central part of the bottom wall 3 because the leg portions 105, 106 and 107 are mounted in the side walls 10 provided on both the left and the right sides of the bottom wall 3, and can receive a circuit substrate having a control circuit for controlling the driving motor 35 in the space 3*a*. In addition, with a receiving circuit incorporated in the circuit substrate, the walking apparatus 1 can conduct driving control of the driving motors 35 by an external controller. Further, the number of driving motors 35 used in this embodiment is two, it goes without saying that it may be one. A power source is not limited to the driving motor 35 but a power spring, a flywheel and so on can be adopted as a power source.

FIG. 9 shows the walking apparatus 1 having a cover 120 in an insect form attached to it. Since the walking apparatus 1 has the leg portions 105, 106 and 107 extending from the sides of the apparatus body 2, when attached the cover 120 in an insect form, it closely resembles a real insect. When a plurality of walking apparatuses 1 are put in one box, they make moves that are not different from those of real insects as a result of the walking apparatuses moving onto each other's backs, which is extremely realistic. Further, a cover is not limited to an insect form but various forms of covers may be attached.

A walking apparatus according to the first aspect of the present invention has such an effect that, since long slender legs are inserted through and supported in through holes of rotating members provided on both sides of an apparatus body, it can take the form with the long slender legs extending from the apparatus body of a shape close to a real insect. In addition, since the through holes are provided obliquely with respect to the rotational axial line of the rotating members, the front end parts of the leg portions rotate as if they revolve widely to up and down. This makes the walking apparatus walk with front and rear leg portions touching the ground one after another and therefore, it has the effect that the apparatus body moves up and down and can move rhythmically like a real insect and can easily overcome uneven surfaces in its way.

The leg portions have the effect that the front end parts of the leg portions always face downward and necessarily touch the walking surface because the leg portions have the rear end parts guided to the guiding grooves and are made not to rotate on its axis. They also have the effect that the rhythm of the leg portions touching the surface and the walking form can be changed, and the movement of the entire walking apparatus thereby can be rendered unpredictably interesting because the directions of the through holes of the rotating members can be freely changed.

A walking apparatus according to the second aspect of the present invention has guiding grooves formed such that they are substantially parallel with the rotational axial line of the rotating members, the rear parts of the leg portions extending from the inner opening of the rotating members are bent and the rear end parts are slidably guided to the guiding grooves. The guiding grooves can be properly changed and have the effect that the rear end parts of the leg portions slide smoothly to the guiding grooves because the rotational centers of the leg portions are always over the guiding grooves when the guiding grooves are formed to be substantially parallel with the rotational axial lines of the rotating members.

A walking apparatus according to the third aspect of the present invention has such an effect that it has a space between the side walls and electric parts, such as batteries and circuit substrates, can be incorporated utilizing the space because the leg portions are attached to the rotating members of the left and the right side walls.

A walking apparatus according to the fourth aspect of the present invention walks forward when both the power sources are activated simultaneously to rotate regularly the rotating members of the one side wall and the rotating members of the other side wall to the same direction, and walks backward when activated to rotate them reversedly to the same direction. When both the power sources are activated simultaneously to rotate the rotating members of the one side wall and the rotating members of the other side wall to the different directions, the apparatus turns over quickly in its position. Moreover, when the one power source is activated to rotate only the rotating members of the one side wall, the apparatus rotates about the front end parts of the leg portions of the other side wall. Since there are two power sources provided in this way, the walking apparatus has the effect that it can be moved in a complex manner.

A walking apparatus according to the fifth aspect of the present invention can transfer the power of the power source efficiently because the rotating members are gear wheels.

Thus, it is seen that a walking apparatus is provided. One skilled in the art will appreciate that the present invention can be practiced by other than the preferred embodiments which are presented for the purposes of illustration and not of limitation, and the present invention is limited only by the claims which follow.

What is claimed is:

1. A walking apparatus, comprising:

an apparatus body provided with a power source;

at least two rotating members provided on each of the left and the right sides of the apparatus body;

a through hole formed in each rotating member;

each said through hole being provided obliquely with respect to a rotational axial line of each of the rotating members, and being formed to connect an inner opening and an outer opening, said inner opening being formed toward the center of the inner side surface of a rotating member and said outer opening being formed toward the circumference of the outer side surface of a rotating member;

a leg portion rotatably and slidably mounted to said through hole of each rotating member;

a guiding groove for slidably guiding a rear end part of each leg portion protruding from the inner opening of each rotating member formed in the apparatus body thereby preventing said leg portions from turning on their axes; and each said rotating member connected for rotation by the power source.

2. A walking apparatus according to claim 1, wherein:

each said guiding groove is formed substantially parallel with the rotational axial line of each rotating member; and each said leg portion includes a rear part protruding from the inner opening of each rotating member to be bent and a rear end part guided slidably into a guiding groove.

3. The walking apparatus according to claim 2, wherein:

said apparatus body includes a bottom wall and side walls provided in the left and the right of the bottom wall;

each of said left and the right side walls includes at lest two rotating members; and a guiding groove is formed in the bottom wall.

4. A walking apparatus according to claim 3, wherein said power source includes two power sources, one of which rotates the rotating members in one of the side walls and the other power source rotates the rotating members in the other side wall.

5. A walking apparatus according to claim 4, wherein each said rotating member is a gear wheel.

6. A walking apparatus according to claim 3, wherein each said rotating member is a gear wheel.

7. A walking apparatus according to claim 2, wherein each said rotating member is a gear wheel.

8. A walking apparatus according to claim 1, wherein each said rotating member is a gear wheel.

* * * * *